US005931449A

United States Patent [19]

Gwaltney

[11] Patent Number: 5,931,449

[45] Date of Patent: Aug. 3, 1999

[54] STOCKADE-STYLE SECTIONAL FENCE SYSTEM

[76] Inventor: Lorene Gwaltney, 6309 NW. 84th St., Oklahoma City, Okla. 73132

[21] Appl. No.: 08/985,326

[22] Filed: Dec. 4, 1997

[51] Int. Cl.[6] ..... E04H 17/14

[52] U.S. Cl. ..... 256/24; 256/69

[58] Field of Search ..... 256/21, 22, 24, 256/25, 26, 73, 59, 60, 19, 69; 52/783.11

[56] References Cited

U.S. PATENT DOCUMENTS

| | | | |
|---|---|---|---|
| 3,391,493 | 7/1968 | Lip Fou Wong | 256/24 X |
| 3,482,367 | 12/1969 | Curran | 52/783.11 X |
| 3,698,692 | 10/1972 | Burrows, Jr, | 256/24 X |
| 4,143,857 | 3/1979 | Weiner | 256/24 X |
| 4,306,631 | 12/1981 | Reusser | 256/24 X |
| 4,638,979 | 1/1987 | Demarest | 256/19 X |
| 5,149,061 | 9/1992 | Borgnini | 256/24 |
| 5,628,494 | 5/1997 | Arnold | 256/24 |
| 5,628,495 | 5/1997 | Gandara | 256/24 |

FOREIGN PATENT DOCUMENTS

| | | | |
|---|---|---|---|
| 2094369 | 9/1982 | United Kingdom | 256/73 |

*Primary Examiner*—Harry C. Kim

[57] ABSTRACT

A new stockade-style sectional fence system for providing a fence system that will outlast all types of wood fence designs. The inventive device includes a plurality of fence panels. Each of the fence panels is defined by a plurality of main panels having a plurality of indented spacer panels disposed therebetween. The indented spacer panels are recessed with respect to the main panels. Each of the fence panels has end spacer panels disposed on opposing ends thereof for securement to an adjacent main panel. A pair of rails extend laterally across rear surfaces of the fence panels for securement of the fence panels together. A plurality of mounting posts are provided each having a weighted lower end portion. The weighted lower end portion is positionable within a ground surface. Each of the mounting posts are secured to the pair of rails in a spaced relationship.

5 Claims, 2 Drawing Sheets

STOCKADE-STYLE SECTIONAL FENCE SYSTEM

BACKGROUND OF THE INVENTION

1. Field of the Invention

The present invention relates to plastic fences and more particularly pertains to a new stockade-style sectional fence system for providing a fence system that will outlast all types of wood fence designs.

2. Description of the Prior Art

The use of plastic fences is known in the prior art. More specifically, plastic fences heretofore devised and utilized are known to consist basically of familiar, expected and obvious structural configurations, notwithstanding the myriad of designs encompassed by the crowded prior art which have been developed for the fulfillment of countless objectives and requirements.

Known prior art plastic fences include U.S. Pat. No. 5,215,290 to Khalessi; U.S. Pat. No. 4,477,058 to Lowery; U.S. Pat. Des. No. 339,871 to Reed; U.S. Pat. No. 3,963,219 to D'Amico; U.S. Pat. No. 4,198,034 to Svirklys; and U.S. Pat. No. 4,932,634 to Sura.

While these devices fulfill their respective, particular objectives and requirements, the aforementioned patents do not disclose a new stockade-style sectional fence system. The inventive device one pre-formed section which appears to separate panels. Each of the fence panels has tapered ends for securement to a galvanized steel post. A pair of rails with tapered ends extend laterally across rear surfaces of the main panels for securement of the main panels together onto the post. A plurality of mounting posts are provided each having a weighted lower end portion. The weighted lower end portion is positionable within a ground surface. Each of the mounting posts are secured to the pair of rails in a spaced relationship.

In these respects, the stockade-style sectional fence system according to the present invention substantially departs from the conventional concepts and designs of the prior art, and in so doing provides an apparatus primarily developed for the purpose of providing a fence system that will outlast all types of wood fence designs.

SUMMARY OF THE INVENTION

In view of the foregoing disadvantages inherent in the known types of plastic fences now present in the prior art, the present invention provides a new stockade-style sectional fence system construction wherein the same can be utilized for providing a fence system that will outlast all types of wood fence designs.

The general purpose of the present invention, which will be described subsequently in greater detail, is to provide a new stockade-style sectional fence system apparatus and method which has many of the advantages of the plastic fences mentioned heretofore and many novel features that result in a new stockade-style sectional fence system which is not anticipated, rendered obvious, suggested, or even implied by any of the prior art plastic fences, either alone or in any combination thereof.

To attain this, the present invention generally comprises a plurality of fence panels. Each of the fence panels is defined by a plurality of main panels having a plurality of indented spacer panels disposed therebetween. The spacer panels are recessed with respect to the main panels. Each of the main panels has a pointed upper end extending upwardly beyond upper ends of the spacer panels. A plurality of apertures extend through selected spacer panels in a spaced relationship at upper and lower portions thereof. Each of the fence panels has end spacer panels disposed on opposing ends thereof for securement to an adjacent main panel and to the post at the same time. Each of the end spacer panels has upper and lower apertures therethrough. A pair of rails extend laterally across rear surfaces of the main panels for securement of the main panels together. The pair of rails include an upper rail and a lower rail. The pair of rails extend across the plurality of apertures of the spacer panels at the upper and lower portions thereof. The pair of rails have apertures therethrough aligning with the apertures of the spacer panels. A plurality of mounting posts are provided with each having a weighted lower end portion. The weighted lower end portion is positionable within a ground surface. Each of the mounting posts have upper and lower diametrically opposed apertures therethrough for aligning with the apertures of the upper and lower rails and secured thereto by long bolts with corresponding nuts. A pair of short bolts and nuts couple the rails to the main panels through aligning apertures thereof at positions where the mounting posts are absent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stockade-style sectional fence system apparatus and method which has many of the advantages of the plastic fences mentioned heretofore and many novel features that result in a new stockade-style sectional fence system which is not anticipated, rendered obvious, suggested, or even implied by any of the prior art plastic fences, either alone or in any combination thereof.

It is another object of the present invention to provide a new stockade-style sectional fence system which may be easily and efficiently manufactured and marketed.

It is a further object of the present invention to provide a new stockade-style sectional fence system which is of a durable and reliable construction.

An even further object of the present invention is to provide a new stockade-style sectional fence system which is susceptible of a moderate cost of manufacture with regard to both materials and labor, and which accordingly is then susceptible of moderate prices of sale to the consuming public, thereby making such stockade-style sectional fence system economically available to the buying public.

Still yet another object of the present invention is to provide a new stockade-style sectional fence system which provides in the apparatuses and methods of the prior art some of the advantages thereof, while simultaneously overcoming some of the disadvantages normally associated therewith.

Still another object of the present invention is to provide a new stockade-style sectional fence system for providing a fence system that will outlast all types of wood fence designs.

Yet another object of the present invention is to provide a new stockade-style sectional fence system which includes a continuous molded fence panel. Each of the fence panels is defined by the appearance of main panels having a plurality of spacer panels disposed therebetween. The spacer panels are recessed with respect to the main panels. Each of the fence panels has end spacer panels disposed on opposing ends thereof for securement to an adjacent main panel and at the same time securement to the posts. A pair of rails extend laterally across rear surfaces of the main panels for securement of the main panels together and to the posts. A plurality of mounting posts are provided each having a weighted lower end portion. The weighted lower end portion is positionable within a ground surface. Each of the mounting posts are secured to the pair of rails in a spaced relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
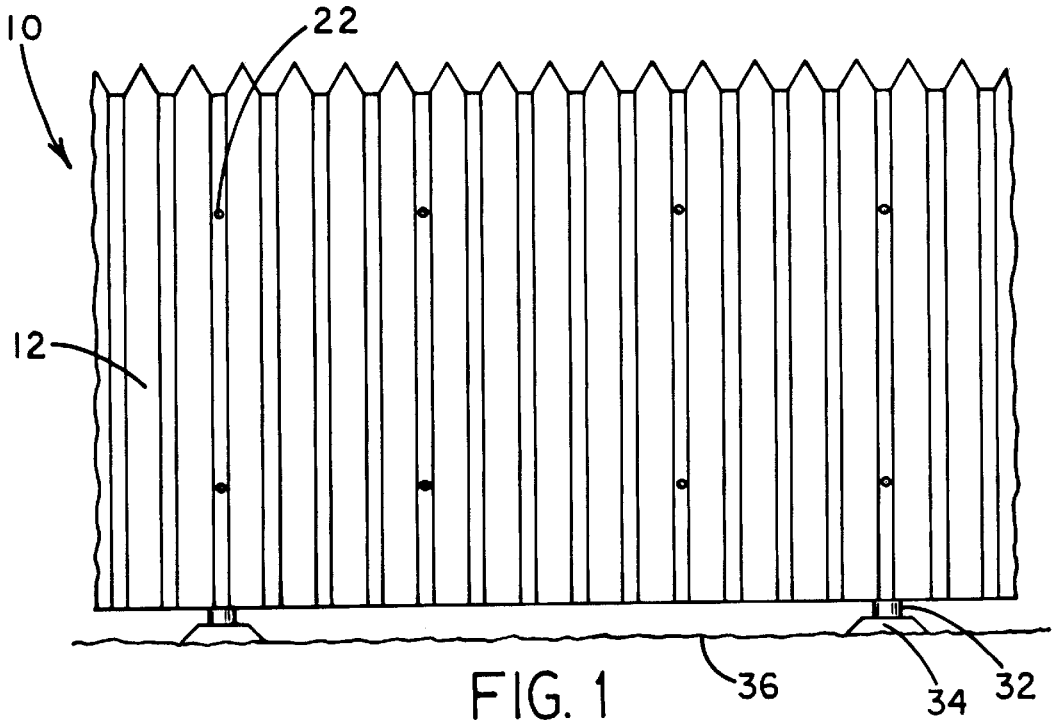
FIG. 1 is a front view of a new stockade-style sectional fence system according to the present invention.
Figure 2:
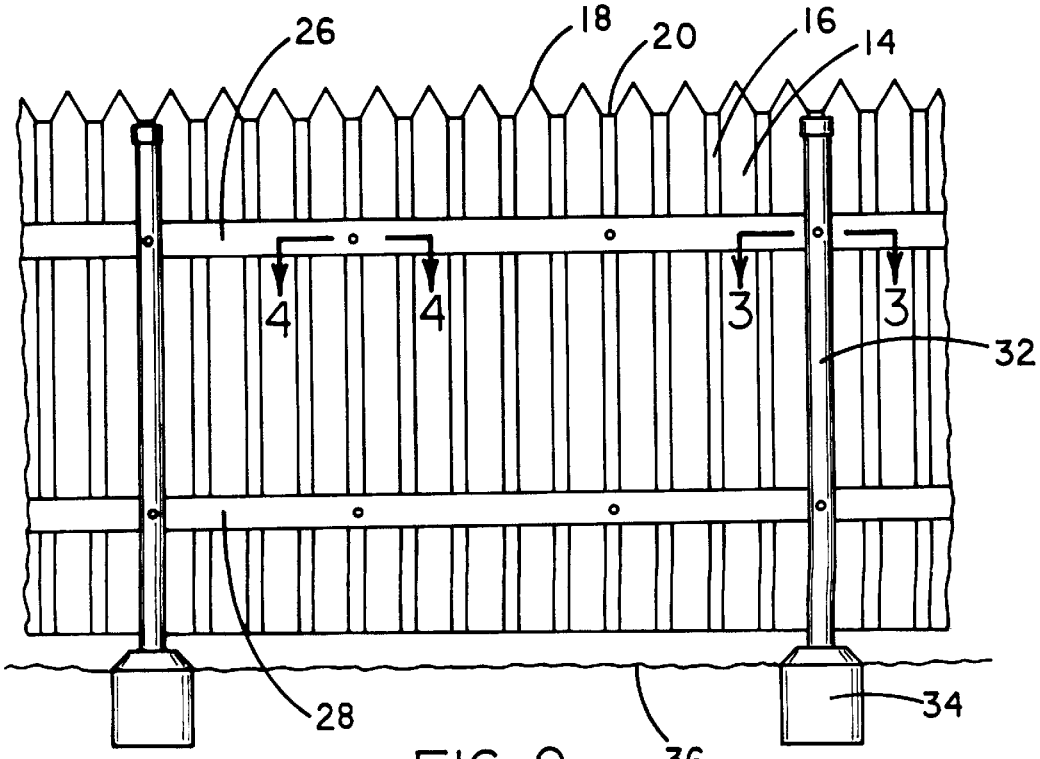
FIG. 2 is a rear view of the present invention.
Figure 3:
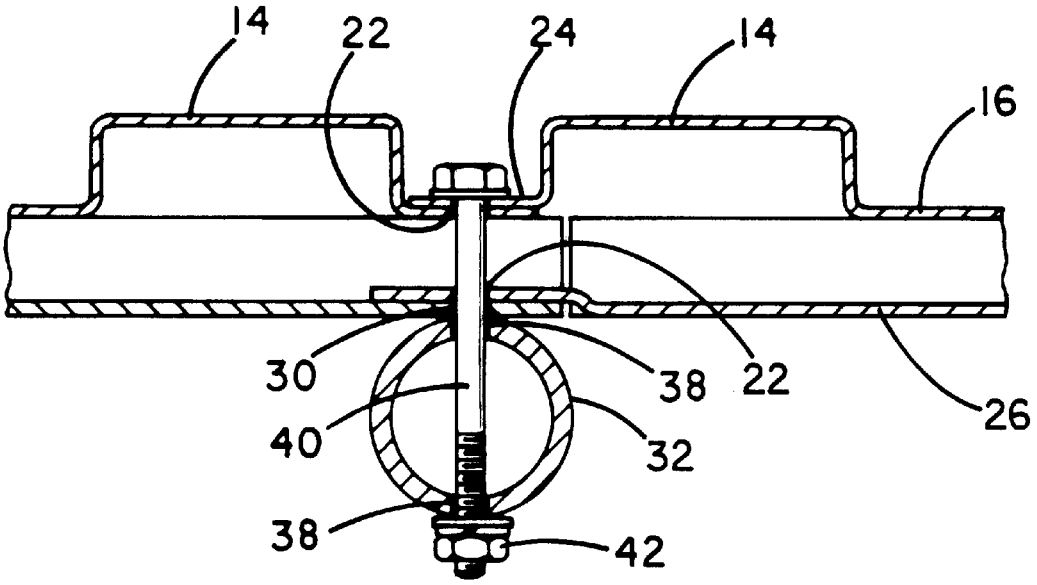
FIG. 3 is a cross-sectional view of the present invention as taken along line 3—3 of FIG. 2.
Figure 4:
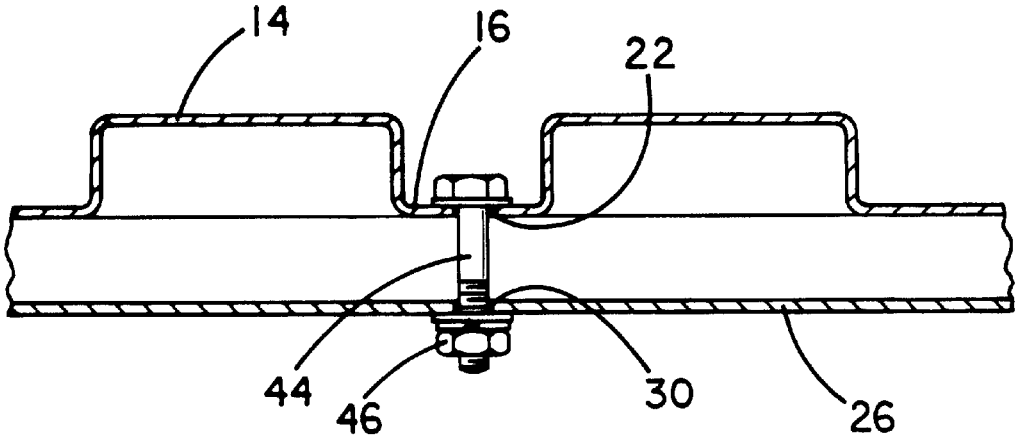
FIG. 4 is a cross-sectional view of the present invention as taken along line 4—4 of FIG. 2.

With reference now to the drawings, and in particular to FIGS. 1 through 4 thereof, a new stockade-style sectional fence system embodying the principles and concepts of the present invention and generally designated by the reference numeral 10 will be described.

As best illustrated in FIGS. 1 through 4, the stockade-style sectional fence system 10 comprises a plurality of fence panels 12. Each of the fence panels 12 is defined by a plurality of main panels 14 having a plurality of spacer panels 16 disposed therebetween. The spacer panels 16 are recessed with respect to the main panels 14. Each of the main panels 14 has a pointed upper end 18 extending upwardly beyond upper ends 20 of the spacer panels 16. A plurality of apertures 22 extend through selected spacer panels 16 in a spaced relationship at upper and lower portions thereof. Each of the fence panels 12 has end spacer panels 24 disposed on opposing ends thereof for securement to an adjacent main panel 12. Each of the end spacer panels 24 has upper and lower apertures 22 therethrough.

A pair of rails extend laterally across rear surfaces of the fence panels 1 for securement of the fence panels 12 together. The pair of rails include an upper rail 26 and a lower rail 28. The pair of rails extend across the plurality of apertures 22 of the spacer panels 16 at the upper and lower portions thereof. The pair of rails have apertures 30 therethrough aligning with the apertures 22 of the spacer panels 16.

A plurality of mounting posts 32 are provided with each having a weighted lower end portion 34. The weighted lower end portion 34 is positionable within a ground surface 36. Each of the mounting posts 32 have upper and lower diametrically opposed apertures 38 therethrough for aligning with the apertures 30 of the upper and lower rails 26,28 and secured thereto by long bolts 40 with corresponding nuts 42. A pair of short bolts 44 and nuts 46 couple the rails 26,28 to the fence panels 12 through aligning apertures thereof at positions where the mounting posts 32 are absent.

In use, the system 10 would act as a privacy fence. The fence panels 12 can be produced from polyvinylchloride-coated aluminum sheet. The mounting posts 32 can be produced from rectangular or round cross-section galvanized steel. The apertures 38 of the mounting posts 32 allow them to be bolted to the rails 26,28 and the fence panels 12. The rails 26,28 can be produced from rectangular cross-section vinyl-coated aluminum that would be sized and proportioned to resemble standard two by fours that are traditionally used for this purpose. The fence panels 12, when viewed from above, would have a shallow toothed profile designed to simulate the individual vertical slats normally used on this type of fence. The vinyl coated metal construction of this system 10 would make it impervious to rotting, thus enabling it to outlast all types of existing wooden fence designs.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stockade-style sectional fence system for providing a fence system that will outlast all types of wood fence designs comprising, in combination:

a plurality of pre-formed fence panels, each of the fence panels being defined by a plurality of main panels having a plurality of indented spacer panels disposed therebetween, the spacer panels being recessed with respect to the main panels, each of the main panels having a pointed upper end extending upwardly beyond upper ends of the spacer panels, a plurality of apertures extending through selected spacer panels in a spaced relationship at upper and lower portions thereof, each of the fence panels having end spacer panels disposed on opposing ends thereof for securement to an adjacent main panel, each of the end spacer panels having upper and lower apertures therethrough;

a pair of rails extending laterally across rear surfaces of the fence panels for securement of the fence panels together, the pair of rails including an upper rail and a lower rail, the pair of rails extending across the plurality of apertures of the spacer panels at the upper and lower portions thereof, the pair of rails having apertures therethrough aligning with the apertures of the spacer panels; and a plurality of mounting posts each having a weighted lower end portion, the weighted lower end portion positionable within a ground surface, each of the mounting posts having upper and lower diametrically opposed apertures therethrough for aligning with the apertures of the upper and lower rails and secured thereto by long bolts with corresponding nuts, a pair of short bolts and nuts coupling the rails to the pre-formed fence panels through aligning apertures thereof at positions where the mounting posts are absent.

2. A sectional fence system for providing a fence system that will outlast all types of wood fence designs comprising, in combination:

a plurality of pre-formed fence panels, each of the fence panels being defined by a plurality of main panels having a plurality of indented spacer panels disposed therebetween, the spacer panels being recessed with respect to the main panels, each of the fence panels having end spacer panels disposed on opposing ends thereof for securement to an adjacent main panel, each of the end spacer panels having upper and lower apertures therethrough;

a pair of rails extending laterally across rear surfaces of the fence panels for securement of the fence panels together, the pair of rails extending across the apertures of the spacer panels, the pair of rails having apertures therethrough for aligning with the apertures of the spacer panels for coupling purposes; and a plurality of mounting posts each having a weighted lower end portion, the weighted lower end portion positionable within a ground surface, each of the mounting posts having apertures therethrough for aligning with the apertures of the spacer panels and the pair of rails and being secured to the spacer panels and the pair of rails by coupling means extending through the aligned apertures;

wherein the fence panels and the pair of rails are constructed from a polyvinylchloride-coated aluminum.

3. The sectional fence system as set forth in claim 2 wherein each of the main panels has a pointed upper end extending upwardly beyond upper ends of the indented spacer panels.

4. The sectional fence system as set forth in claim 2 wherein the coupling means comprises long bolts with corresponding nuts coupling the fence panels with the pair of rails and the mounting posts.

5. The sectional fence system as set forth in claim 4 wherein small bolts with corresponding nuts couple the fence panels with the pair of rails at positions where the mounting posts are absent.

* * * * *